US011937743B2

(12) United States Patent
Niederberger

(10) Patent No.: US 11,937,743 B2
(45) Date of Patent: Mar. 26, 2024

(54) FASTENING ARRANGEMENT FOR A WC FLAP ELEMENT

(71) Applicant: GEBERIT INTERNATIONAL AG, Jona (CH)

(72) Inventor: Martin Niederberger, Uznach (CH)

(73) Assignee: GEBERIT INTERNATIONAL AG, Jona (CH)

( * ) Notice: Subject to any disclaimer, the term of this patent is extended or adjusted under 35 U.S.C. 154(b) by 809 days.

(21) Appl. No.: 16/965,536

(22) PCT Filed: Jan. 29, 2019

(86) PCT No.: PCT/EP2019/052128

§ 371 (c)(1),
(2) Date: Jul. 28, 2020

(87) PCT Pub. No.: WO2019/145566

PCT Pub. Date: Aug. 1, 2019

(65) Prior Publication Data

US 2021/0045592 A1 Feb. 18, 2021

(30) Foreign Application Priority Data

Jan. 29, 2018 (EP) ..... 18153793
Jan. 29, 2018 (EP) ..... 18153795
(Continued)

(51) Int. Cl.
*A47K 13/12* (2006.01)
*E03C 1/322* (2006.01)
(Continued)

(52) U.S. Cl.
CPC ..... *A47K 13/12* (2013.01); *E03C 1/322* (2013.01); *E03C 1/324* (2013.01); *E03D 11/125* (2013.01);
(Continued)

(58) Field of Classification Search
CPC . A47K 13/24–28; F16B 33/044; E03D 11/16; E03D 11/125
See application file for complete search history.

(56) References Cited

U.S. PATENT DOCUMENTS 2,550,357 A * 4/1951 Jansen ..... F16B 33/004 411/965
2005/0217008 A1 10/2005 Vierkant, III et al.
(Continued)

FOREIGN PATENT DOCUMENTS

CN 2715681 Y 8/2005
CN 101087551 A 12/2007
(Continued)

OTHER PUBLICATIONS

International Search Report of PCT/EP2019/052128 dated Apr. 23, 2019 [PCT/ISA/210].
(Continued)

*Primary Examiner* — Jacob J Cigna
(74) *Attorney, Agent, or Firm* — Sughrue Mion, PLLC

(57) ABSTRACT

A fastening system for a WC flap element, which can be flapped away from a support surface of a toilet bowl, comprising at least one mounting bolt extending along a center axis with a receiving portion, a stop portion for direct or indirect support on the support surface of the toilet bowl and a threaded portion, a hinge support, for mounting the WC flap element, with at least one mounting opening into which the receiving portion of the mounting bolt projects, and a non-rotatably mounted mating thread, into which the threaded portion of the mounting bolt engages. In the installed position, the center axis of the mounting bolt extends substantially at a right angle with respect to the horizontal. The receiving portion comprises a drive structure
(Continued)

and the mounting opening is open toward the top, so that the drive structure is accessible and actuatable from the top.

20 Claims, 3 Drawing Sheets

(30) Foreign Application Priority Data

Jan. 29, 2018 (EP) ..... 18153796
Jan. 29, 2018 (EP) ..... 18153797

(51) Int. Cl.
*E03C 1/324* (2006.01)
*E03D 11/12* (2006.01)
*E03D 11/14* (2006.01)
*E03D 11/16* (2006.01)
*E03D 11/17* (2006.01)

(52) U.S. Cl.
CPC ..... *E03D 11/143* (2013.01); *E03D 11/16* (2013.01); *E03D 11/17* (2013.01)

(56) References Cited

U.S. PATENT DOCUMENTS

2007/0250996 A1 11/2007 Li
2009/0113610 A1 5/2009 Lin et al.
2013/0198942 A1 8/2013 Leibfried
2018/0353021 A1* 12/2018 Krabbe ..... A47K 13/26

FOREIGN PATENT DOCUMENTS

| | | | |
|---|---|---|---|
| CN | 103945748 | A | 7/2014 |
| CN | 204091873 | U | 1/2015 |
| CN | 106419714 | A | 2/2017 |
| CN | 107427170 | A | 12/2017 |
| DE | 87 03 919 | U1 | 5/1987 |
| DE | 202014101077 | U1 | 6/2014 |
| JP | 2003-24246 | A | 1/2003 |
| JP | 2003-265364 | A | 9/2003 |
| JP | 2007-29347 | A | 2/2007 |
| JP | 2008-514282 | A | 5/2008 |
| WO | 2012/125535 | A2 | 9/2012 |
| WO | 2016/001318 | A1 | 1/2016 |

OTHER PUBLICATIONS

Communication dated Jul. 10, 2018 in European Application No. 18153797.8.

* cited by examiner

FASTENING ARRANGEMENT FOR A WC FLAP ELEMENT

CROSS REFERENCE TO RELATED APPLICATIONS

This application is a National Stage of International Application No. PCT/EP2019/052128, filed Jan. 29, 2019, claiming priorities to European Patent Application Nos. 18153797.8, 18153795.2, 18153793.7 and 18153796.0 filed Jan. 29, 2018 respectively.

TECHNICAL FIELD

The present invention relates to a fastening arrangement for a WC flap element, such as a WC seat or a WC lid, according to the preamble of claim 1.

PRIOR ART

A variety of fastening arrangements for a flap element is disclosed in the prior art.

For example, WO 2016/001318 shows a possible way of fastening a WC seat, wherein mounting bolts by way of which a WC seat can be connected are used. The position of the mounting bolts can be aligned by a positioning aid, wherein, after alignment has taken place, the annular space between the mounting bolt and the WC ceramics is filled by a gap filler and the mounting bolt is mechanically fixed by a nut. The fastening solution according to WO 2016/001318 is disadvantageous, because a separate positioning aid has to be used for the alignment of the WC seat in relation to the toilet bowl and because it is difficult to access the securing means of the mounting bolt.

Other solutions use screwed connections, in which it is disadvantageous that the alignment is typically very laborious and that a removal of the seat ring, for example during a complete cleaning operation, is very complex and the seat ring has to be realigned.

SUMMARY OF THE INVENTION

Proceeding from the prior art, an object of the invention is to specify a fastening system for a WC flap element, such as a seat ring and/or a toilet lid, which overcomes the disadvantages of the prior art. In particular, it is intended to specify a fastening system for a WC flap element by means of which the WC flap element can be aligned more easily. A further, particularly preferred object is to specify a fastening system for a WC flap element by means of which the WC flap element can be aligned more easily on condition that a cleaning operation is simple.

At least one of the stated objects is achieved by a fastening system according to claim 1. A fastening system for a WC flap element which can be flapped away from a support surface, lying in the horizontal, of a toilet bowl, comprises at least one, in particular two or at least two, mounting bolts extending along a center axis and with a receiving portion, a stop portion for direct or indirect support on the support surface of the toilet bowl and a threaded portion, a hinge support for mounting the WC flap element with at least one mounting opening into which the receiving portion of the mounting bolt projects, and a non-rotatably mounted mating thread, into which the threaded portion of the mounting bolt engages. In the installed position, the center axis of the mounting bolt extends substantially at a right angle with respect to the horizontal. The receiving portion comprises a drive structure and the mounting opening is open toward the top, so that the drive structure is accessible and actuatable from the top.

During the assembly, it is thus possible to align and then, after alignment has taken place, to securely screw, by way of the drive structure that is accessible from the top, the hinge support, in particular with the WC flap element. Consequently, alignment with a template or repeated aligning is dispensed with. Furthermore, an easy-to-separate connection is provided on account of the connection to the hinge support by way of the mounting bolt, so that the hinge support with the WC flap element can be easily separated from the toilet bowl for cleaning.

In the present context, the phrasing "from the top" is to be understood as the drive portion being accessible from above the support surface in the installed position. That is to say, for example, a tool can be moved into the drive structure in the vertical direction from the top in the direction of the support surface.

The phrasing "horizontal" is to be understood as the support surface lying in the one horizontal plane in the installed position, which plane is at a right angle to the vertical direction.

The cross section of the receiving portion and the cross section of the mounting opening are preferably chosen such that the mounting bolt can be rotated relative to the mounting opening. The receiving portion and the mounting opening are preferably formed cylindrically with a constant diameter. As an alternative, the receiving portion and the mounting opening are formed as a cone.

Preferably also lying between the stop portion and the threaded portion is a transitional portion, which extends through a fastening opening in the toilet bowl in the installed position.

The number of fastening openings, the number of mounting bolts and the number of mounting openings are matched to one another and correspond to one another.

The drive structure is preferably arranged at the end face on the free end of the receiving portion. In this way, good access from the top can be provided. Furthermore, the drive structure is visible when viewed from the top and can be clearly seen by the user.

The drive structure preferably extends from the end face of the receiving portion into the receiving portion. In this way, a simple structure can be provided.

The drive structure can have a variety of forms, the form being chosen such that a tool can transmit a rotation to the mounting bolt. The drive structure is preferably a square socket or a hexagonal socket or a slot or a cross recess or a Torx socket.

The receiving portion preferably has a constant external diameter, wherein the external diameter is not enlarged in the region of the drive structure. That is to say, the drive structure can be of a very compact form. The diameter of the mounting opening is also substantially identical to the external diameter of the receiving portion. In this way, a good mounting can be achieved.

As seen in the installed position, the drive structure particularly preferably lies completely inside the mounting opening. The drive structure is accessible in particular from the top through the mounting opening. That is to say, a tool can be guided to the drive structure through the mounting opening. The position inside the mounting opening has the advantage that the drive structure is protected from external influences.

In other words, the free end of the receiving portion lies inside the mounting opening and does not project out of the mounting opening. Consequently, the depth of the mounting opening is greater than the length of the receiving portion.

It would also be conceivable for the free end with the drive structure to project out of the mounting opening.

The stop portion preferably has an annular surface toward the support surface of the toilet bowl, wherein an elastic disk element lies between the annular surface and the support surface. The disk element has a top side, which is of a complementary or matching form with respect to the annular surface and is in contact with the annular surface. The disk element also has a bottom side, which rests on the support surface. The disk element is preferably of an elastic form.

Said annular surface is preferably rounded in a concave manner and the top side is rounded in a convex manner. This has the advantage that the position of the mounting bolt can still be slightly varied, which is an advantage specifically in the field of ceramic toilet bowls. As a result, manufacturing tolerances on the toilet bowl can be easily compensated. Alternatively, the annular surface is rounded in a convex manner and the top side is rounded in a concave manner. In both variants, the bottom side runs substantially in a plane.

The annular surface and the top side may, however, also be of a planar form.

Toward the hinge support, the stop portion preferably has an annular surface on which the hinge support stands. Alternatively, the hinge support stands on the support surface.

The mating thread is preferably part of a sliding block, which is mounted in a guide groove with play in at least one direction. The sliding block is preferably mounted with play in a plurality of directions, wherein the mounting is preferably such that the sliding block can move parallel to the support surface.

The play of the sliding block in the guide groove corresponds substantially to the play of the mounting bolt in the fastening opening of the toilet bowl. The play of the mounting bolt in the fastening opening is achieved by a difference in diameter between the diameter of the fastening opening and the diameter of the parts of the mounting bolt that project through the fastening opening.

The guide groove is preferably part of a frame element, which is mounted in a rear receiving space in the toilet bowl. The frame element may, for example, be part of a mounting structure by means of which the toilet bowl can be fastened to a wall. The frame element may, however, also be otherwise used or specifically may be mounted in said rear receiving space for receiving the grooved element.

The receiving portion preferably has at least one spring ring for securing the hinge support, wherein the at least one spring ring is preferably the sole securing element between the hinge support and the mounting bolt. This has the advantage that the assembly and disassembly of the hinge support are very easy. In particular, further securing means, such as screws, cotter pins or the like are not necessary in order to secure the hinge support with respect to the mounting bolts.

The hinge support preferably extends along a hinge axis and, as seen transversely to the hinge axis, in cross section its outer form is constant substantially over the entire length. This is thus a beam-like structure, which can be formed with a compact cross section. The hinge support can have incisions and reinforcing ribs.

The mounting opening preferably runs at a right angle to the hinge axis and, as seen in cross section, lies substantially centrally in relation to the hinge support.

At each end face, the hinge support preferably has a receiving opening in which a hinge element is mounted. The WC flap element is mounted on the hinge element. The mounting opening preferably penetrates the receiving opening and the hinge element extends around the cross section of the mounting opening. That is to say, there is no collision between the hinge element and the mounting bolt, which projects into the mounting opening. Alternatively, a hinge part protrudes from the hinge support at the end face in the direction of the hinge axis.

An arrangement comprises a fastening system according to the above description and a WC flap element, pivotably mounted on the hinge support and in particular designed as a seat ring and/or a lid, and a toilet bowl, on which the fastening system is mounted by way of the mounting bolt(s).

The toilet bowl preferably comprises two leadthrough openings spaced apart from one another, through which the mounting bolt is guided. That is to say, there are preferably two mounting bolts present, which are spaced apart from one another.

The hinge support is preferably covered by a cover element. The cover element preferably extends over the entire hinge support.

A method for assembling a fastening system according to the above description is characterized in that,

- in a first step, the mounting bolt is brought into engagement with the mating thread by way of its threaded portion such that the mounting bolt can be displaced in its position relative to the toilet bowl,
- in a second step, the hinge support is brought into connection with the mounting bolts; and
- in a third step, the WC flap element is aligned with respect to the toilet bowl; and
- in a fourth step, after alignment has taken place, the mounting bolt is tightened by way of the drive structure,
- wherein, in a fifth, optional step, a cover element covering the hinge support is assembled.

Further embodiments are specified in the dependent claims.

BRIEF DESCRIPTION OF THE DRAWINGS

Preferred embodiments of the invention are described below with reference to the drawings, which merely serve for explanation and are not to be interpreted as restrictive. In the drawings.

DESCRIPTION OF PREFERRED EMBODIMENTS

The figures show a fastening system 1 for a WC flap element 2 on a toilet bowl 4. The WC flap element 2 can be flapped away from a support surface 3 which lies in the horizontal H and is part of a toilet bowl 4. The WC flap element 2 is typically a WC lid and/or a WC seat ring.

Figure 1:
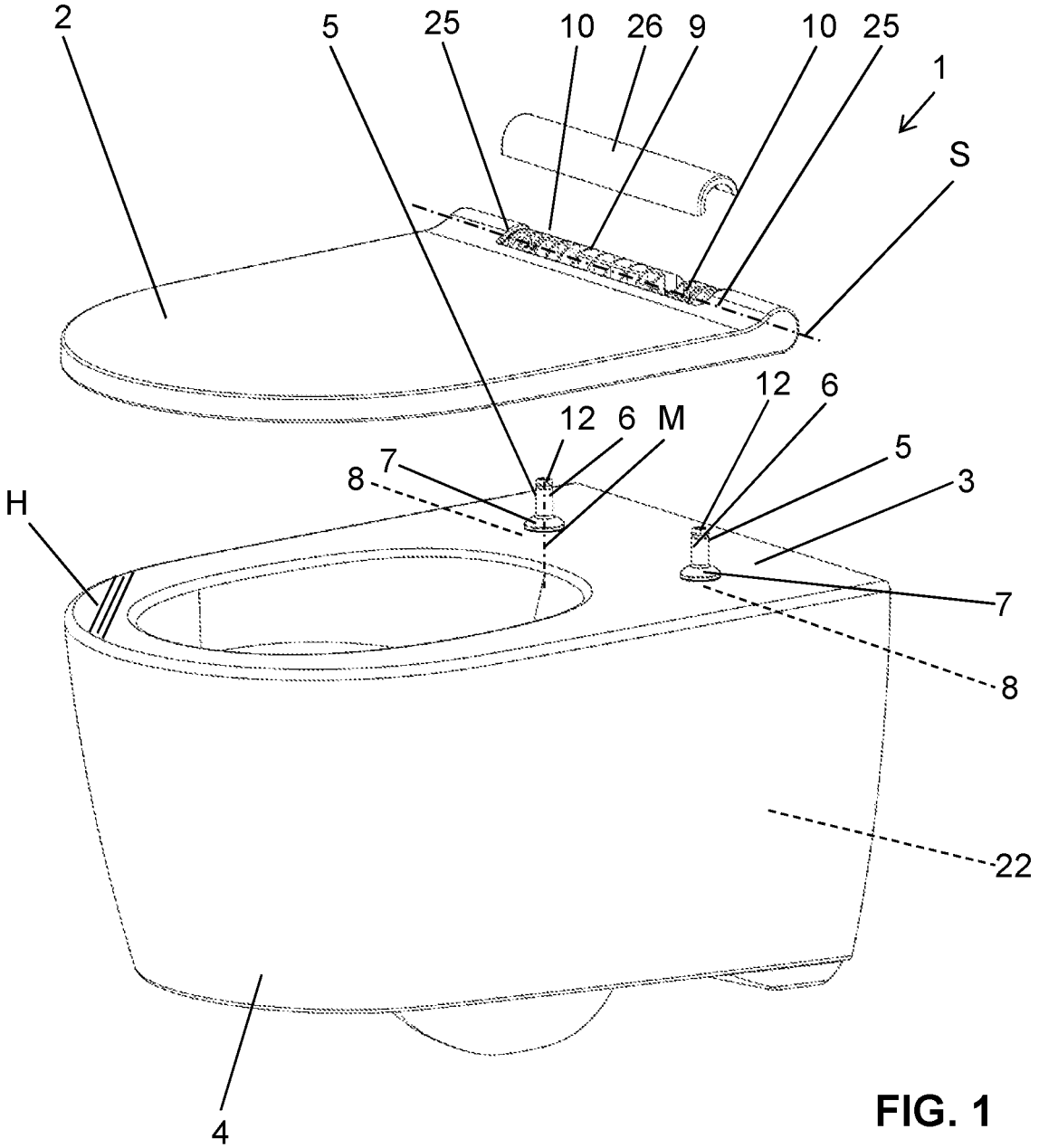
FIG. 1 shows a schematic exploded illustration of a fastening system according to the invention with a toilet bowl according to a preferred embodiment.

FIG. 1 shows an exploded illustration, in which the WC flap element 2 is shown spaced apart from the support surface 3.

The fastening system 1 comprises at least one mounting bolt 5 extending along a center axis M. Here, two mounting bolts 5 are arranged. FIG. 1 shows the basic arrangement of the two mounting bolts 5. The two mounting bolts 5 are spaced apart from one another. A part of the mounting bolt 5 extends upwardly from the support surface 3 of the toilet bowl 4 along the center axis M. In this case, the center axis M is oriented substantially at a right angle to the horizontal H. Another part of the mounting bolt extends into the toilet bowl 4 via a fastening opening 28 of the toilet bowl 4.

The fastening system 1 also comprises a hinge support 9 for pivotably mounting the WC flap element 2 on the toilet bowl 4. The hinge support 9 can be brought into connection with the at least one mounting bolt 5 and is mounted on the toilet bowl 4 by way of the at least one mounting bolt 5.

As is shown in the figures, the mounting bolt 5 comprises a receiving portion 6, an adjoining stop portion 7 and a threaded portion 8. In the embodiment shown, the threaded portion 8 is formed on the stop portion 7 via a bridging portion 27. The receiving portion 6 serves for mounting the hinge support 9. The stop portion 7 can be connected directly or indirectly to the support surface 3 of the toilet bowl 4.

Figure 2:
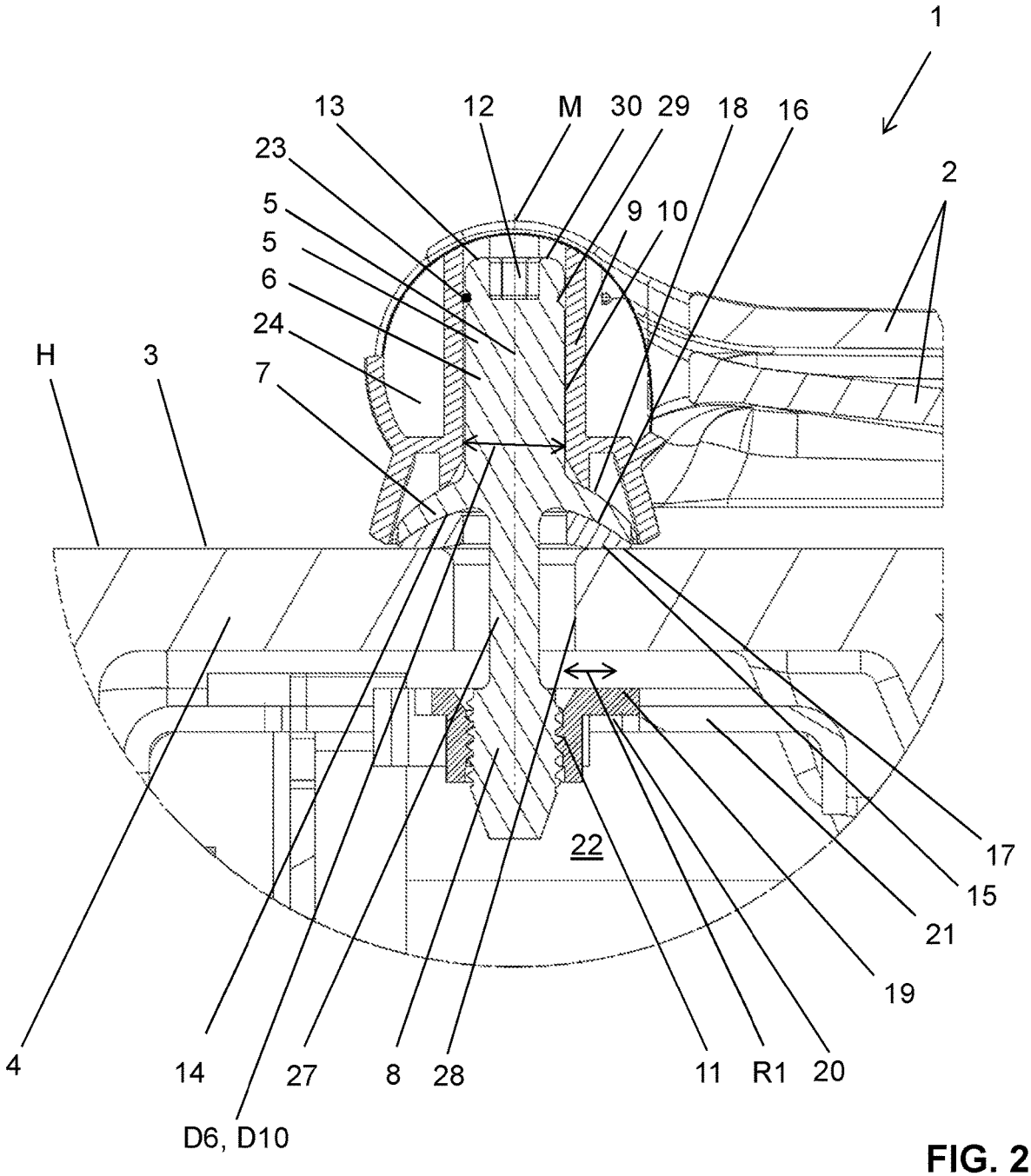
FIG. 2 shows a sectional illustration through the center axis of a mounting bolt of the fastening system according to FIG. 1.

FIG. 2 shows a sectional illustration through the center axis M of the mounting bolt 5. It can be clearly seen here that the fastening system 1 furthermore has a mating thread 11 mounted non-rotatably with respect to the mounting bolt 5 and into which the mounting bolt 5 engages. The threaded portion 8, which extends underneath the stop portion 7 in the direction of the center axis, can be brought into engagement with the mating thread 11. In the embodiment shown, the threaded portion 8 is an external thread and the mating thread 11 is an internal thread.

In the embodiment shown, the receiving portion 6 and the stop portion 7 extend in the upward direction away from the support surface 3, while the threaded portion 8 or the bridging portion 27 shown here extend in the downward direction toward the mating thread 11 through a fastening opening 28 in the toilet bowl 4. The bridging portion 27 has at least one length which is slightly greater than the depth of the fastening opening 28, wherein in addition the diameter of the bridging portion 27 is preferably smaller than the external diameter of the threaded portion 8. The external diameter of the bridging portion 27 is smaller than the diameter of the fastening opening 28, resulting in play between the mounting bolt 5 and the fastening opening 28. If the threaded portion 8 directly adjoins the stop portion 7, that is to say when no bridging portion 27 is present, the external diameter of the threaded portion 8 is smaller than the diameter of the fastening opening 28. In this way, play is likewise accomplished.

In the embodiment shown, the receiving portion 6 extends into a mounting opening 10 on the hinge support 9. In this way, the hinge support 9 is mounted on the mounting bolt 5. The hinge support 9 comprises two mounting openings 10 arranged spaced apart from one another. The two mounting openings 10 are spaced apart from one another at the same distance as the two mounting bolts 5. In the embodiment shown, toward the hinge support 9, the stop portion 7 has an annular surface 18 on which the hinge support 9 stands.

The receiving portion 6 furthermore comprises a drive structure 12, by way of which the mounting bolt 5 can be made to rotate about its center axis M. The installer can use a tool to engage into the drive structure 12 and consequently set the mounting bolt 5 in rotation. In this way, the threaded portion 8 of the mounting bolt 5 is screwed into the mating thread 11. As shown in the figures, the mounting opening 10 is open toward the top, so that the drive structure 12 is accessible and actuatable from the top. The accessibility from the top can be seen particularly well in FIGS. 2 and 3.

During the assembly, the mounting bolt 5 can be brought into engagement with the mating thread 11 by way of the threaded portion 8 and gently tightened, so that the mating thread 11 and the mounting bolt 5 can move relative to the support surface 3 within the play. In this case, the movement is in particular transverse to the fastening opening 28, the fastening opening 28 having a diameter which is greater than the maximum diameter of the mounting bolt 5, so that a corresponding play can be provided. After gently tightening the mounting bolt 5, the installer can place the hinge support 9 on the receiving portion 6 and then align the entire WC flap element 2 with respect to the toilet bowl 4. After alignment has taken place, the installer can then tighten the mounting bolt 5 with respect to the mating thread 11 by way of the drive structure 12, so that no further displacement is achieved. During the tightening, the stop portion 7 is pulled against the support surface 3. For the actuation of the drive structure 12, a suitable tool can be inserted into the mounting opening 10, said tool then engaging into the drive structure 12 so that the mounting bolt 5 is made to rotate with respect to the stationary mating thread.

The drive structure 12 extends from the end face 30 of the receiving portion 6 into the receiving portion 6. The drive structure 12 is arranged at the end face on the free end 13 of the receiving portion 6. The drive structure 12 is integrally formed on the mounting bolt 5 and in this case extends from its end face into the receiving portion 6. A change in the diameter of the mounting bolt 5 in the region of the drive structure 12 is not necessary.

The receiving portion 6 has a constant external diameter D6, wherein, as stated, the external diameter D6 is not enlarged in the region of the drive structure. The external diameter D6 of the receiving portion 6 is substantially identical to the diameter D10 of the mounting opening 10. In the embodiment shown, the drive structure 12 is designed as a hexagonal socket. The drive structure may, however, also be of a different form, such as for example a Torx socket.

In the installed position, the drive structure 12 lies completely inside the mounting opening 10. That is to say, the end face 30 also lies completely inside the mounting opening 10. In this way, the advantage is obtained that the end of the receiving portion 6 lies inside the mounting opening 10 and no protruding parts, which would project out of the mounting opening 10 in the upward direction, are present.

From FIG. 2 it can be seen clearly that, toward the support surface 3, the stop portion 7 has an annular surface 14. An elastic disk element 15 is arranged between the annular surface 14 and the support surface 3. The elastic disk element 15 has a top side 16, which is of a complementary form to the annular surface 14. The disk element 15 is preferably composed of plastic.

In the embodiment shown, the annular surface 14 of the stop portion 7 is formed as a concavely rounded surface, whereas the top side 16 of the disk element 15 is formed as a convex surface. In this way, angular tolerances which may result from the formation of the support surface 3 can be compensated.

The bottom side 17 of the disk element 15 rests on the support surface 3. In this case, the disk element 15 is preferably dimensioned such that the stop portion 7 does not rest directly on the support surface 3. This is an indirect support between the stop portion 7 and the support surface 3. A direct support would also be conceivable, it then being possible to dispense with the disk element 15.

Toward the hinge support 9, the stop portion 7 has a further annular surface on which the hinge support 9 stands. Here, the hinge support 9 stands on the annular surface 14 by way of the peripheral regions of the mounting opening 10.

Figure 3:
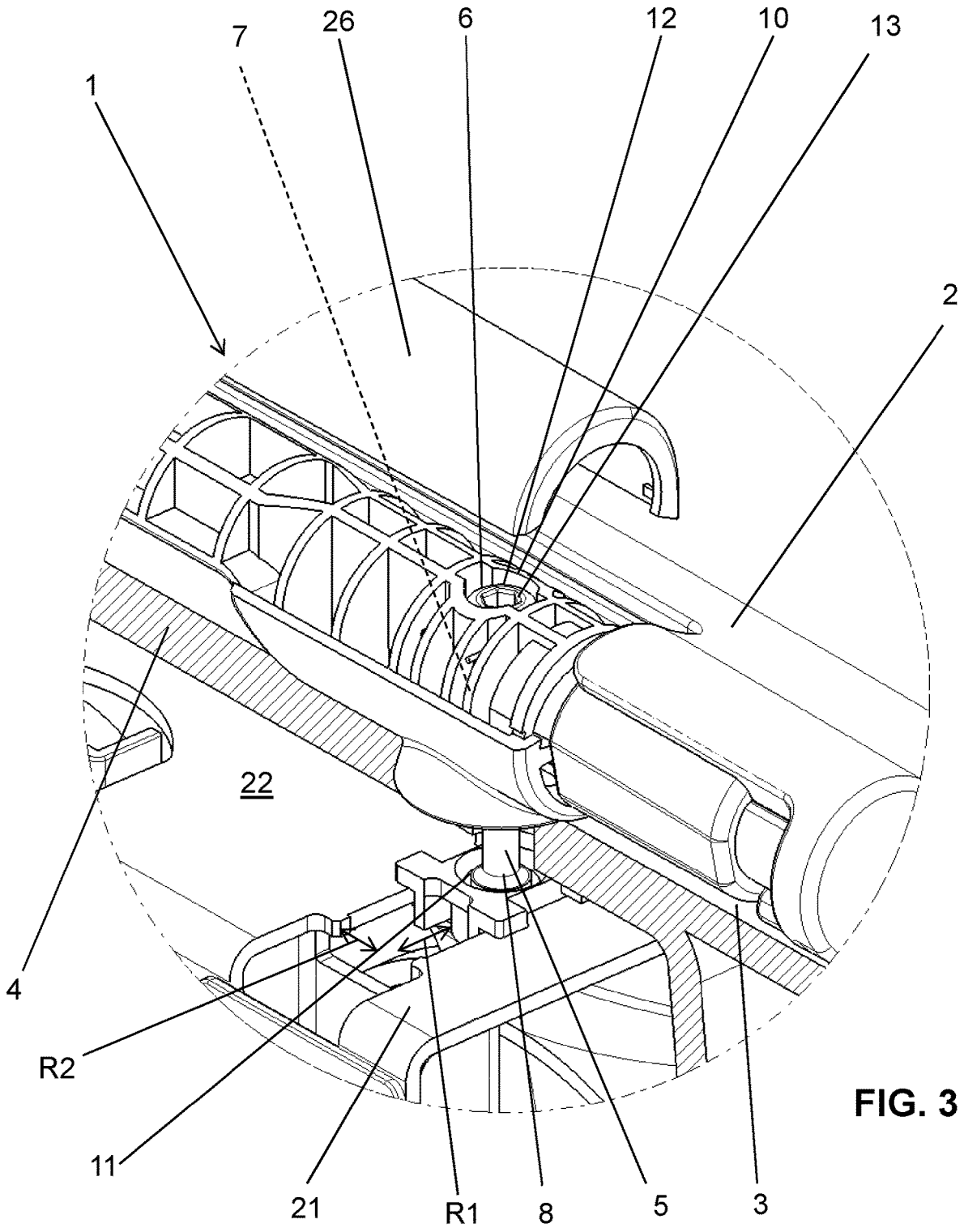
FIG. 3 shows another sectional illustration through the center axis of a mounting bolt of the fastening system according to FIGS. 1 and 3.

As shown in FIG. 3, the mating thread 11 is a constituent part of a sliding block 19. The sliding block 19 is mounted in a guide groove 20 with play in at least one direction R1, R2. In the embodiment shown, the sliding block 19 can be moved freely in two different directions R1, R2, which are at a right angle to one another. The movability is preferably such that the mating thread 11 underneath the fastening opening 28 of the toilet bowl 4 can assume any position within the fastening opening 28.

Here, the guide groove 20 is part of a frame element 21, which is mounted in a rear receiving space 22 in the toilet bowl. The frame element 21 may also serve, for example, to fasten the toilet bowl 4 to the wall. The frame element 21 is fixedly mounted in said receiving space 2.

For securing the hinge support 9, the receiving portion 6 has at least one spring ring 23. Here, the spring ring 23 is mounted in a spring ring groove 29. The spring ring 23 is particularly preferably the sole securing element between the receiving portion 6 and the hinge support 9, so that the hinge support 9 can be easily separated from the receiving portion 6, for example for cleaning work.

It can be clearly seen in FIGS. 1 and 3 that the hinge support 9 extends in a beam-like manner along a hinge axis S. As seen transversely to the hinge axis S, the cross section is constant in its outer form substantially over the entire length of the hinge support 9. The mounting opening 10 is at a right angle to the hinge axis S and, as seen in the cross section of the hinge support, is arranged substantially centrally with respect to the hinge support 9.

At each end face, the hinge support 9 has a receiving opening 24 in which a hinge element 25 is mounted. Here, the hinge element 25 connects the WC flap element 2 to the hinge support 9. The mounting opening 10 penetrates the receiving opening 24, the hinge element 25 extending around the cross section of the mounting opening 10.

In another embodiment, at the end face, a hinge part can protrude from the hinge support 9 in the direction of the hinge axis S. In this case, the hinge part is fixedly formed on the hinge support 9.

The figures also show that the hinge support 9 is covered by a cover element 26.

A method for assembling a fastening system according to the above description is characterized by the following steps:

- in a first step, the mounting bolt 5 is brought into engagement with the mating thread 11 by way of its threaded portion 8 such that the mounting bolt 5 can be displaced in its position relative to the toilet bowl 4,
- in a second step, the hinge support 9 is brought into connection with the mounting bolts 5; and
- in a third step, the WC flap element 2 is aligned with respect to the toilet bowl 4; and
- in a fourth step, after alignment has taken place, the mounting bolt 5 is tightened by way of the drive structure 12.

In a fifth, optional step, a cover element 26 covering the hinge support 9 is assembled.

LIST OF REFERENCE SIGNS

1 Fastening system
2 WC flap element
3 Support surface
4 Toilet bowl
5 Mounting bolt
6 Receiving portion
7 Stop portion
8 Threaded portion
9 Hinge support
10 Mounting opening
11 Mating thread
12 Drive structure
13 Free end
14 Annular surface
15 Disk element
16 Top side
17 Bottom side
18 Annular surface
19 Sliding block
20 Guide groove
21 Frame element
22 Receiving space
23 Spring ring
24 Receiving opening
25 Hinge element
26 Cover element
27 Bridging portion
28 Fastening opening
29 Spring ring groove
30 End face
H Horizontal
M Center axis
D6 Diameter of receiving portion
D10 Diameter of mounting opening
R1, R2 Direction
S Hinge axis

The invention claimed is:

1. A fastening system for a WC flap element which can be flapped away from a support surface, lying in the horizontal, of a toilet bowl, comprising:

at least one mounting bolt extending along a center axis with a receiving portion, a stop portion for direct or indirect support on the support surface of the toilet bowl, and a threaded portion, a hinge support, for mounting the WC flap element, with at least one mounting opening into which the receiving portion of the mounting bolt projects, and a non-rotatably mounted mating thread, into which the threaded portion of the mounting bolt engages, wherein, in an installed position, the center axis of the mounting bolt extends substantially at a right angle with respect to the horizontal, wherein the receiving portion comprises a drive structure, wherein the mounting opening is open toward a top, so that the drive structure is accessible and actuatable from the top, and wherein the mating thread is part of a sliding block, which is mounted in a guide groove with play in at least one direction.

2. The fastening system as claimed in claim 1, wherein the receiving portion has a constant external diameter, wherein the external diameter is not enlarged in the region of the drive structure, and/or wherein the diameter of the mounting opening is substantially identical to the external diameter of the receiving portion.

3. The fastening system as claimed in claim 1, wherein the drive structure lies completely inside the mounting opening in the installed position.

4. The fastening system as claimed in claim 1, wherein toward the hinge support, the stop portion has an annular surface on which the hinge support stands.

5. The fastening system as claimed in claim 1, wherein the guide groove is a part of a frame element, which is mounted in a rear receiving space in the toilet bowl.

6. The fastening system as claimed in claim 1,
wherein for securing the hinge support, the receiving portion has at least one spring ring, or
wherein for securing the hinge support, the receiving portion has at least one spring ring, and
wherein the at least one spring ring is the sole securing element.

7. The fastening system as claimed in claim 1,
wherein the hinge support has end faces,
wherein at each end face, the hinge support has a receiving opening in which a hinge element is mounted,
wherein the hinge element extends around the cross section of the mounting opening, or
wherein the mounting opening penetrates the receiving opening and the hinge element extends around the cross section of the mounting opening; or
wherein a hinge part protrudes from the hinge support at the end face in the direction of the hinge axis.

8. The fastening system as claimed in claim 1, wherein the drive structure is arranged at an end face on a free end of the receiving portion.

9. The fastening system as claimed in claim 8, wherein the drive structure extends from the end face of the receiving portion into the receiving portion.

10. The fastening system as claimed in claim 1,
wherein the stop portion has an annular surface toward the support surface, and
wherein between the annular surface and the support surface lies an elastic disk element, which has a top side, which is of a complementary form with respect to the annular surface and is in contact with the annular surface, and has a bottom side, which rests on the support surface.

11. The fastening system as claimed in claim 10,
wherein the annular surface is rounded in a concave manner and wherein the top side is rounded in a convex manner, or
wherein the annular surface is rounded in a convex manner, and
wherein the top side is rounded in a concave manner; and/or wherein the bottom side runs substantially in a plane.

12. The fastening system as claimed in claim 1,
wherein the hinge support extends along a hinge axis, and
wherein, as seen transversely to the hinge axis, in cross section its outer form is constant substantially over the entire length.

13. The fastening system as claimed in claim 12, wherein the mounting opening runs at a right angle to the hinge axis and, as seen in cross section, lies substantially centrally in relation to the hinge support.

14. An arrangement comprising a fastening system and a WC flap element,
said fastening system comprises
at least one, mounting bolt extending along a center axis with a receiving portion, a stop portion for direct or indirect support on the support surface of a toilet bowl and a threaded portion,
a hinge support, for mounting the WC flap element, with at least one mounting opening into which the receiving portion of the at least one mounting bolt projects, and
a non-rotatably mounted mating thread, into which the threaded portion of the mounting bolt engages,
wherein, in an installed position, the center axis of the at least one mounting bolt extends substantially at a right angle with respect to the horizontal,
wherein the receiving portion comprises a drive structure,
wherein the mounting opening is open toward a top, so that the drive structure is accessible and actuatable from the top,
wherein the mating thread is part of a sliding block, which is mounted in a guide groove with play in at least one direction, and
wherein said WC flap element is pivotably mounted on the hinge support and the toilet bowl, on which the fastening system is mounted by way of the at least one mounting bolt.

15. The arrangement as claimed in claim 14, wherein the hinge support is covered by a cover element.

16. The arrangement according to claim 14, wherein the at least one mounting bolt comprises two mounting bolts.

17. The arrangement according to claim 14, wherein said WC flap element is configured as at least one of a seat ring or a lid.

18. A method for assembling a fastening system, comprising
at least one mounting bolt extending along a center axis with a receiving portion, a stop portion for direct or indirect support on the support surface of a toilet bowl and a threaded portion,
a hinge support, for mounting the WC flap element, with at least one mounting opening into which the receiving portion of the at least one mounting bolt projects, and
a non-rotatably mounted mating thread, into which the threaded portion of the mounting bolt engages,
wherein, in an installed position, the center axis of the at least one mounting bolt extends substantially at a right angle with respect to the horizontal,
wherein the receiving portion comprises a drive structure,
wherein the mounting opening is open toward a top, so that the drive structure is accessible and actuatable from the top,
wherein the mating thread is part of a sliding block, which is mounted in a guide groove with play in at least one direction,
wherein in a first step, the at least one mounting bolt is brought into engagement with the mating thread by way of its threaded portion such that the at least one mounting bolt can be displaced in its position relative to the toilet bowl,
wherein in a second step, the hinge support is brought into connection with the at least one mounting bolt; and
wherein in a third step, the WC flap element is aligned with respect to the toilet bowl; and
wherein in a fourth step, after alignment has taken place, the at least one mounting bolt is tightened by way of the drive structure, and
wherein, in a fifth, optional step, a cover element covering the hinge support is assembled.

19. The method according to claim 18, wherein the at least one mounting bolt comprises two mounting bolts.

20. The method according to claim 18, wherein said WC flap element is configured as at least one of a seat ring or a lid.

* * * * *